US007050359B2

(12) United States Patent
Dagan

(10) Patent No.: US 7,050,359 B2
(45) Date of Patent: May 23, 2006

(54) CLOCK WITH PERCEIVED GRAVITY-DEFYING TIME INDICATOR

(76) Inventor: Gideon Dagan, 986 Vernon Ave., Venice, CA (US) 90201

( * ) Notice: Subject to any disclaimer, the term of this patent is extended or adjusted under 35 U.S.C. 154(b) by 304 days.

(21) Appl. No.: 10/208,622

(22) Filed: Jul. 30, 2002

(65) Prior Publication Data

US 2004/0022136 A1 Feb. 5, 2004

(51) Int. Cl.

| | |
|---|---|
| ***G04B 19/00*** | (2006.01) |
| ***G04B 25/00*** | (2006.01) |
| ***G04B 19/06*** | (2006.01) |
| ***G04C 17/00*** | (2006.01) |

(52) U.S. Cl. ..... 368/223; 368/228

(58) Field of Classification Search ..... 368/78, 368/80, 76, 223, 228, 62, 232, 238; 116/204
See application file for complete search history.

(56) References Cited

U.S. PATENT DOCUMENTS

| | | | | |
|---|---|---|---|---|
| 2,353,280 | A * | 7/1944 | Swisher | 368/220 |
| 2,557,399 | A | 6/1951 | Teetor | |
| 2,859,968 | A * | 11/1958 | Modica, Jr. | 473/594 |
| 2,958,181 | A * | 11/1960 | Laughlin | 368/228 |
| 3,102,362 | A * | 9/1963 | Neal | 446/129 |
| 3,595,010 | A * | 7/1971 | Kaiser | 368/76 |
| 3,701,252 | A * | 10/1972 | Okamoto | 368/80 |
| 3,750,151 | A | 7/1973 | Dill | |
| 3,775,963 | A | 12/1973 | Clapham | |
| 4,723,232 | A | 2/1988 | Beebe | |
| 4,822,044 | A | 4/1989 | Perkitny | |
| 5,159,583 | A | 10/1992 | Lee | |
| 5,184,970 | A | 2/1993 | Binkley | |
| 5,272,681 | A | 12/1993 | Lee | |
| 5,638,340 | A | 6/1997 | Schiefele | |
| 5,805,531 | A | 9/1998 | Schafer | |
| 5,842,721 | A | 12/1998 | Kawabe | |
| 5,850,373 | A | 12/1998 | Lee | |
| 6,116,755 | A | 9/2000 | Masateru | |
| 6,388,953 | B1 | 5/2002 | Wu | |

FOREIGN PATENT DOCUMENTS

| | | |
|---|---|---|
| DE | G 84 34 517.9 | 4/1985 |
| DE | G 93 02 267.0 | 10/1993 |

* cited by examiner

*Primary Examiner*—Daniel J. Colilla
*Assistant Examiner*—Leo T. Hinze
(74) *Attorney, Agent, or Firm*—Seldon & Scillieri

(57) ABSTRACT

A clock with a seemingly gravity-defying time-indicating element adjacent a substantially vertically disposed dial comprises a magnetic guide element positioned behind the dial for movement around the dial as a function of time, and a magnetically responsive time-indicating element such as a metallic-appearing sphere positioned for viewer visibility in front of the dial. The time-indicating element is magnetically coupled to the guide element for movement therewith around the front of the dial in apparent defiance of gravity to indicate the time without becoming decoupled from the guide element. The time-indicating element is a generally hollow shell of non-magnetically responsive material, with an internal, generally tubular and generally space-enclosing member extending across its interior to capture and restrict the movement of a magnetically-responsive coupling element positioned within the generally tubularly enclosed space, and sized to move freely therewithin so that any surface of the coupling element can generally abut the interior wall of the time-indicating element at either end of the tubular enclosure, said coupling element being mechanically coupled to the time-indicating element for movement therewith and magnetically coupled to the guide element through the dial for time-responsive movement of the time-indicating element.

28 Claims, 4 Drawing Sheets

CLOCK WITH PERCEIVED GRAVITY-DEFYING TIME INDICATOR

This invention relates in general to clocks and, more particularly, to a clock having at least one magnetically-responsive time-indicating element disposed in front of a dial that is moved by a guide element disposed behind the dial via magnetic interaction.

BACKGROUND OF THE INVENTION

Chronometric instruments are frequently designed to include visually engaging characteristics. Since all such instruments perform the basic utilitarian function of indicating time, purchasers typically select a particular clock or watch based upon other factors such as aesthetics, eye-catching mechanisms, and the like which render the instrument a conversation piece.

DESCRIPTION OF THE PRIOR ART

In the past, disclosed clocks and watches have utilized magnetically responsive elements in an attempt to create eye-catching illusions. U.S. Pat. No. 5,805,531 for example discloses a watch having a guide element, a time indicator element and a dial interposed between the two. The guide element moves clockwise behind the dial as a function of time. The indicator element is magnetically coupled to the guide element to accordingly move clockwise around the front of the dial. The patent discloses that the indicator element can become decoupled from the guide element, however, so a cage structure is provided between the dial and the watch glass to capture the time indicator and prevent it from being lost when decoupled. The decoupled time indicator is permitted to move freely about the cage. The watch can consequently be pivoted back and forth until the indicator element is recaptured by the magnetic field of the guide element, enabling the time to be read. This watch lacks a gravity-defying structure or appearance and, in fact, provides for the visually-apparent capture of the time-indicating element in normal use.

Another use of a magnetic field is disclosed in U.S. Pat. No. 5,638,340 wherein a ferromagnetic ball is described as being magnetically levitated for reciprocal movement under feedback control to appear as a levitated pendulum.

Still another use of a magnetic field to create a visual illusion is disclosed in U.S. Pat. No. 4,723,232 wherein a clock has a pendulum suspended from a point above the clock dial. The pendulum comprises a magnetically responsive bob that is intermittently coupled to an electrically-pulsed electromagnet under the dial that momentarily holds the bob at time indicating positions vis-à-vis the dial. Unlike the time indicator element in the '531 Patent, above, this ball is tethered by a string, rather than free and also lacks a gravity-defying appearance It is an object of this invention to provide a clock that displays time in a novel and innovative manner through the use of a seemingly gravity-defying time-indicating element.

It is a further object of this invention to provide a clock, which reliably indicates the time at a glance.

SUMMARY OF THE INVENTION

The invention herein is a clock with a seemingly gravity-defying time-indicating element comprising a dial, a guide element formed at least in part from magnetically responsive material and positioned behind the dial for movement around the dial as a function of time, a time-indicating element positioned for viewer visibility in front of the dial, the time-indicating element being less dense than the density of magnetically-responsive material, and a magnetically-responsive coupling element mechanically coupled to the time-indicating element for movement therewith and magnetically coupled to the guide element through the dial for responsive movement of the time-indicating element.

These and other features of the invention will become apparent from the following description of the preferred embodiment, of which the drawing is a part.

DESCRIPTION OF THE DRAWING

In the drawing,

FIG. 1 is a front elevation view of a preferred clock constructed in accordance with the invention; and.

DESCRIPTION OF THE PREFERRED EMBODIMENT

Figure 1:
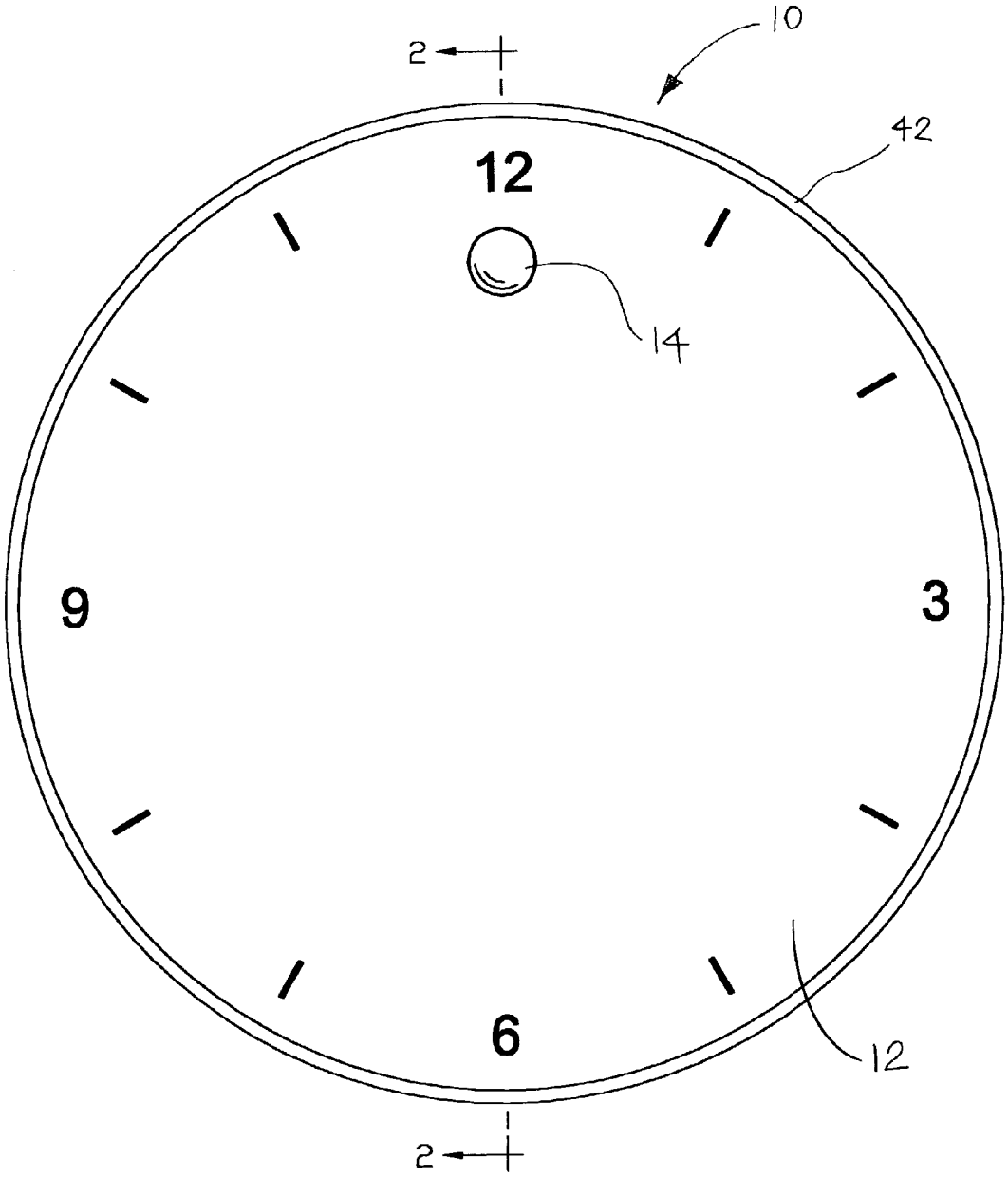

FIG. 1 is a front elevation view of a preferred clock 10 constructed in accordance with the invention. The clock 10 comprises a generally vertically oriented dial 12 having conventional time-indicative indicia circumscribing the dial in the conventional manner. It should be recognized, of course, that other indicia may be used instead, and that no indicia may even be necessary, owing to the viewers' inherent knowledge of the numbers that should be at the respective positions on the face of the dial. Indicia may be placed on the dial by silk screening, engraving, embossing or any other imprinting process. Those skilled in the art will recognize that the dial may be integral with the clock housing 42, as by forming indicia directly onto the housing, or may be a separate structure affixed to the clock in any manner.

A time-indicative element 14 is positioned on the face of the dial 12 at the 12 o'clock position. As will be explained below, the element 14 moves clockwise around the dial as a function of time with no visible means of support. The illustrated clock has a minimalist design in that the element 14 functions as an hour hand, and the time between whole hours is estimated by its position between adjacent indicia. Those skilled in the art will recognize that the clock herein need not be limited to a single indicating element, however.

Figure 2:
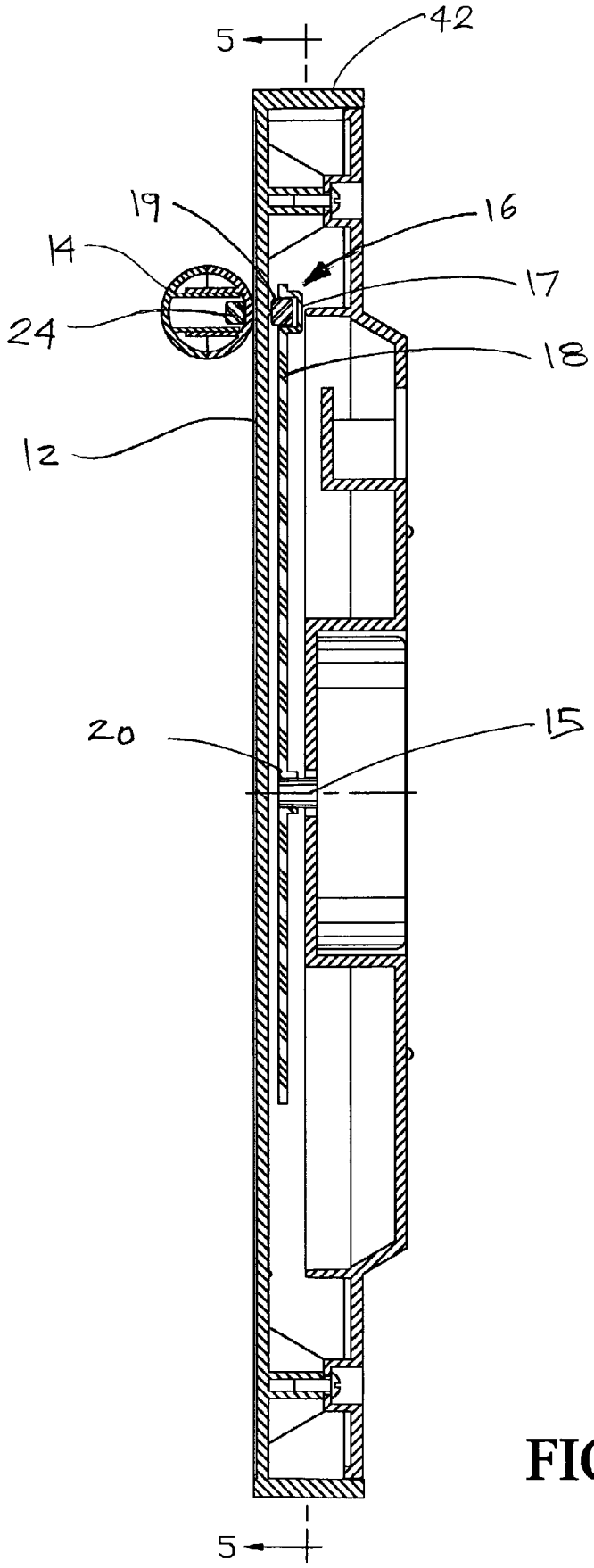
FIG. 2 is a cross-sectional view of the clock depicted in FIG. 1, taken along line 2—2 in FIG. 1.

Turning to FIG. 2, the clock dial 12 is mounted for support on the front exterior surface of the clock housing 42. The time-indicating element 14 is held against the dial 12 by the magnetic attraction to a guide element 16 mounted within the clock housing behind the dial and on one end of a clock arm 18. The arm 18 has a spindle-accommodating aperture 20 through its mid-region which accommodates the spindle of a clock motor (not shown) for rotation about axis 22 as a function of time. The guide element is preferably formed with a pocket 17 in which a small magnet 19 is retained. Those skilled in the art will recognize that numerous other techniques for rendering the guide element 16, or the end of the arm 18, magnetic could be employed without departing from the scope of the invention.

Figure 4:
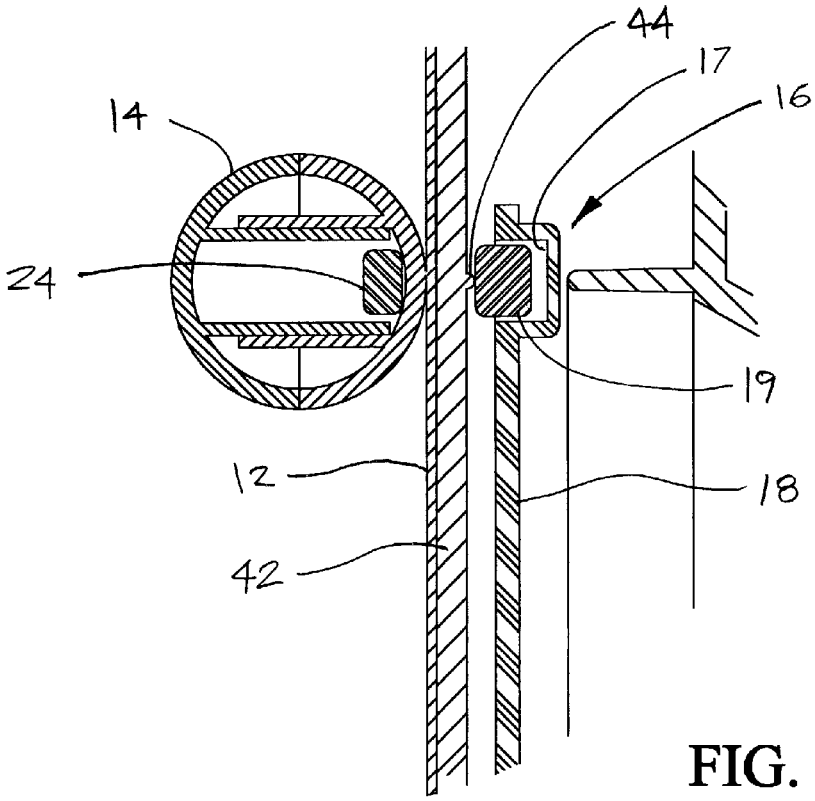
FIG. 4 is an enlarged view of a portion of FIG. 2 showing the area of the clock adjacent the time-indicating element.

AS best shown in FIG. 4, the pocket 17 is preferably sized to loosely capture the magnet 19 so that the magnet can still move towards the dial in response to the magnetic coupling with the time-indicating element. Allowing this movement substantially prevents the time-indicating element 14 from tending to pivot the arm 18 about the spindle. That pivoting movement could bend the arm 18, unduly wear bearings within the clock motor which support the spindle, and otherwise impose an undesirable force on the clock movement. The magnet 19 can be any of a number of shapes including but not limited to cylindrical, annular cubic, etc.

Returning to FIG. 2, the guide element 16 is positioned behind the clock dial 12 for clockwise movement around the dial as a function of time. The time-indicating element 14 is magnetically coupled through the dial 12 to the guide element 16 for movement around the dial therewith. The time-indicative element 14 is preferably ball-shaped or cylindrically shaped to minimize the area of surface contact between the element 14 and dial 12, and thereby minimize friction as the element moves upon the dial surface.

It is highly desirable to prevent the time-indicating element 14 from falling off the generally vertical dial of the clock because the clock will be non-functional without it. Unlike the watch disclosed in U.S. Pat. No. 5,805,531 which has a generally horizontal dial that is easily pivoted by wrist motion and the like to recapture the time-indicating element if it becomes decoupled, the clock herein has a generally vertical dial, is typically much larger than a watch and is typically mounted in a stationary manner. It is desirable to accomplish this without the use of heavy powerful magnets, since the use of such magnets would increase the torques required to move the time-indicating element as well as the amount of friction between the time-indicating element and the clock's dial. Accordingly, the element 14 is preferably formed as a substantially hollow ball or cylinder of lightweight plastic. By providing a density much lighter than that of an element formed wholly of magnetically responsive material, less force is required to reliable retain magnetic coupling between the generally vertically oriented clock dial and the time-indicating element 14. Moreover, the element 14 may be painted to appear metallic, enhancing the visual perception of a relatively heavy metallic element that is defying gravity.

To make the element 14 magnetically responsive, a small lightweight magnet or magnetically responsive element 24 is positioned within the element 14 to couple it to the guide element 16 without adding an amount of weight that would tend to decouple it from the clock. It should be recognized, of course, that one or both of the element 24 and guide element 16 could comprise a magnet, and that one of the two could alternatively be formed from a magnetically-responsive metal without departing from the invention. In the preferred embodiment, the guide element 16 and the element 24 both comprise rare earth magnets, providing strong magnetic attraction with less required weight.

Figure 3:
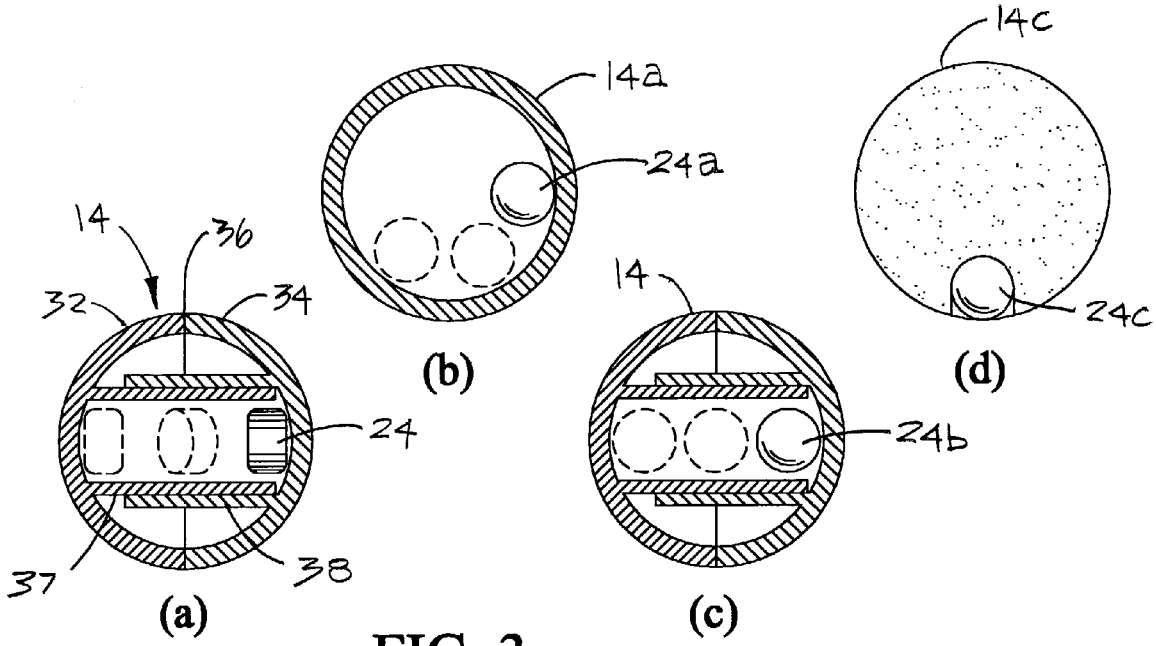
FIGS. 3*a–d* are respectively enlarged sectional views of the time-indicating element of FIG. 2 showing alternative structures thereof.

FIGS. 3*a–d* are enlarged sectional views of the time-indicating element 14 showing some of the alternative structures that may be utilized. FIG. 3*a* illustrates the embodiment shown in FIG. 2. The time-indicating element 14 of FIG. 3*a* comprises a pair of mating hemispheres 32, 34 that sealingly abut along respective generally circular faces at 36 to form a generally hollow sphere. Each of the hemispheres 32, 34 has an open-ended, generally cylindrical wall 37, 38 extending inwardly from the inside wall of the hemisphere towards and beyond the plane of the hemisphere's circular face. The diameters of the cylindrical spaces thus enclosed are such that the inwardly extending cylindrical wall of one hemisphere extends within the cylindrical wall of the other hemisphere when the two hemispheres are brought into abutting position as illustrated. The magnet or magnetically responsive element 24, as the case may be, is cylindrically shaped, and placed within the narrower of the two cylindrical spaces prior to assembling and sealing the hemispheres, capturing it within the close-ended tubular space thusly formed. As illustrated in FIG. 3*a,* the magnetic element 24 is freely movable in only one direction (i.e., horizontally), keeping the magnet's poles oriented for best magnetic coupling when the time-indicating element is positioned onto the dial 12. Moreover, the orientation of the tubular space defined by this configuration ensures that the equatorial seam formed at the interface between the abutting hemispheres will be generally parallel to the face of the dial and, therefore, less visible to an observer so that the visual effect of a seemingly solid element is enhanced.

Alternatively, as shown in FIG. 3*b,* a spherically shaped element 24*a* of magnetically responsive material may be placed within a hollow sphere or cylinder-shaped time-indicating element 14*a,* and permitted to freely move into a magnetically coupled position when placed against the clock dial. This permits the time-indicating element to be mounted to the dial in any orientation. As illustrated in FIG. 3*c,* a spherically shaped element 24*b* can be placed within a pair of hemisphere-shaped bodies having an internal structure like that shown in FIG. 3*a*. As shown in FIG. 3*d,* a lightweight foam element 14*c* of open-celled or closed-cell material, for example, can also be utilized with a spherical, cylindrical or other conveniently-shaped magnetic element 24*c*. Lastly, a lightweight material can be mixed with iron filings to form the time-indicating element as well.

Naturally, semi-cylindrical bodies could be used to form a cylindrical time-indicating element, etc. The invention is not limited to the particular shape of the time-indicating element in that regard. In addition, the magnetic element 24, 24*a* can alternatively be affixed in place by glue or other means, although the permitted free movement within the enclosed time-indicating element 14 permits the element 14 to be placed in a coupling relationship with the guide element 16 with less manual manipulation since the magnetic element 24 can move within the element 14 to correctly align with the magnetic field.

In accordance with the invention, the preferred clock has a number of features incorporated to enhance the movement of the time-indicating element 14 and guide element 16 in a reliable manner. As shown most clearly in FIGS. 4 and 5, the preferred dial is mounted on the front exterior surface of the clock housing 42. The rear face of the dial is provided with a circumferential rib 44 in the region contacted by the magnet 19 as it travels clockwise as a function of time. Those skilled in the art will recognize that this rib is formed in the interior front face of the clock housing when the dial is integrated part of the housing such as by molding, engraving, embossing the indicia onto the exterior front face of the housing. The rib 44 substantially reduces the contact surface area of the magnet 19 and rear dial surface, reducing the generated friction for smooth movement and reduced wear. Alternatively, the rib can be formed on the frontward-facing surface of the guide element 16, and other friction reducing means known in the art can be used in addition to, or instead of, the rib.

Figure 5:
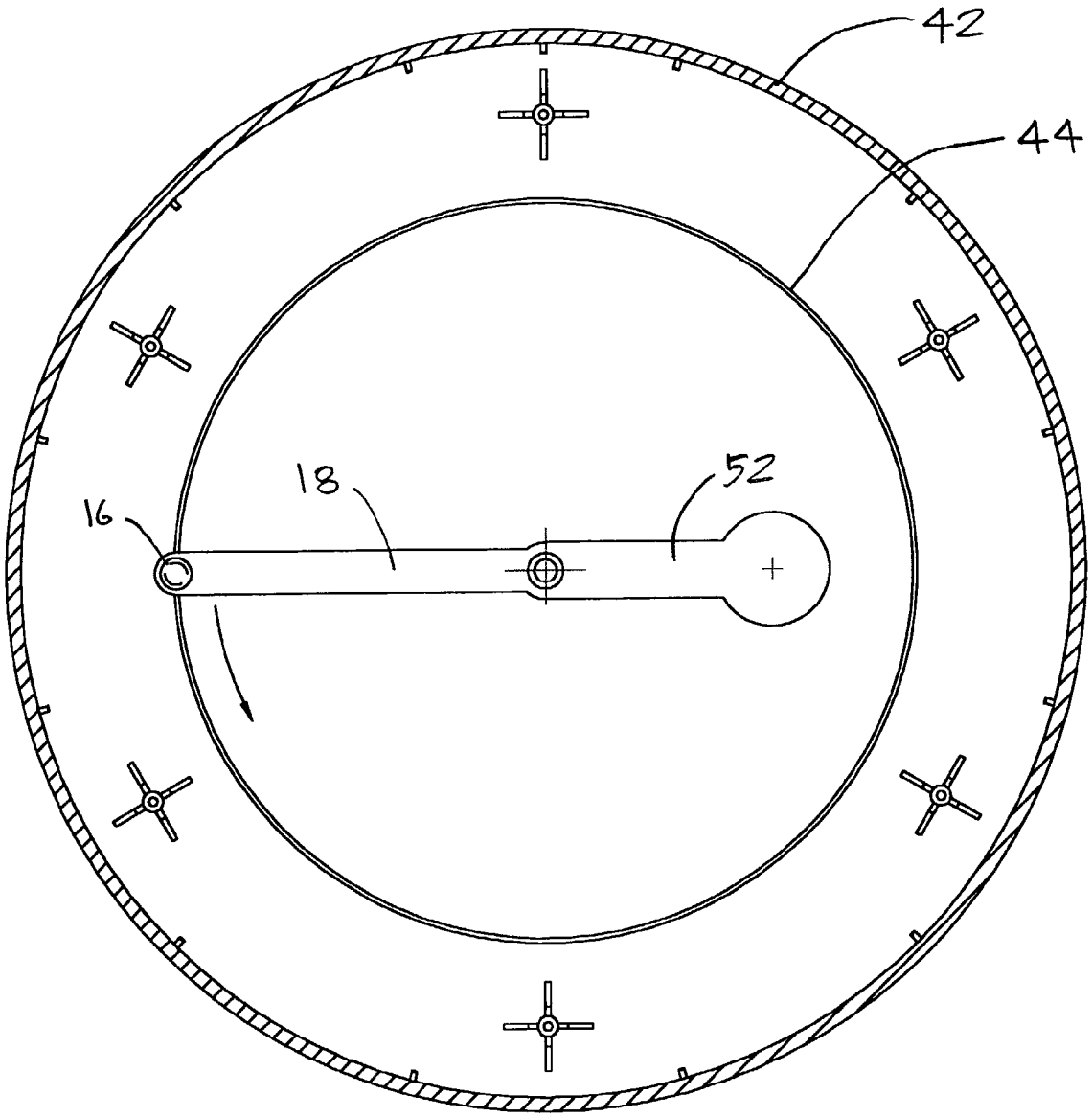
FIG. 5 is a front sectional view in schematic along the line 5—5 in FIG. 2 showing a preferred arm mounted for rotational movement within the clock housing.

To further reduce friction and wear, the arm 18 on which the guide element 16 sits is counter-weighted at the end opposite the guide element to balance the moment arms about the motor spindle. As shown in FIG. 5, the arm 18 has a relatively wider distal segment 52 at the end opposite the guide means 16. When the clock motor rotates the arm 18, it is working against the weight of the magnet 19 and the friction between the magnet 19 and rear dial face (with or without a friction-reducing structure such as the rib 44). These forces act through moment arms in accordance with known physical laws. The counterweight of the arm's distal end serves to substantially offset these forces through an opposing moment arm.

While the foregoing description includes detail, which will enable those skilled in the art to practice the invention, it should be recognized that the description is illustrative in nature and that many modifications and variations will be apparent to those skilled in the art having the benefit of these teachings. It is accordingly intended that the invention herein be defined solely by the claims appended hereto and that the claims be interpreted as broadly as permitted in light of the prior art.

The invention claimed is:

1. A clock with a seemingly gravity-defying time-indicating element comprising:

a dial;

a guide element formed at least in part from magnetically responsive material and positioned behind the dial for movement around the dial as a function of time;

means for moving the guide element around the dial as a function of time;

a generally hollow time-indicating element defined by interior and exterior walls and positioned for viewer visibility in front of the dial, the time-indicating element being less dense than the density of magnetically-responsive metal; and a magnetically-responsive coupling element within the time-indicating element for movement therewith and magnetically coupled to the guide element through the dial for time-responsive movement of the time-indicating element, at least one of the guide element and coupling element being a magnet so that the time-indicating element moves around the dial as a function of time without apparent means of support.

2. The clock of claim 1 wherein the dial is generally vertically oriented.

3. The clock of claim 1 wherein the time-indicating element is formed from a material selected from the group consisting of plastic, non-magnetic material mixed with magnetic filings, open-cell foam material and closed-cell foam material.

4. The clock of claim 1 wherein the time-indicating element has a shape selected from the group consisting of spheres and cylinders.

5. The clock of claim 1 wherein the time-indicating element consists of a pair of mating body parts that sealingly abut along respective faces to form the generally hollow time-indicating element.

6. The clock of claim 5 wherein each of the mating body parts has an open-ended, generally cylindrical wall extending inwardly from the inside wall of the body part towards and beyond the plane of the face, and wherein the respective dimensions of the walls are such that the inwardly extending wall of one of the body parts forms a generally enclosed space within the time-indicating element in cooperation with the wall of the other body part when the two body parts are brought into said abutting position.

7. The clock of claim 6 wherein the magnetically responsive element is captured within the generally enclosed space.

8. The clock of claim 7 wherein the captured magnetically responsive element is freely movable in one dimension.

9. The clock of claim 6 wherein the respective dimensions of the generally cylindrical, inwardly-extending walls are such that at least a portion of one fits within at least a portion of the other to form the generally enclosed space within the time-indicating element when the two mating body portions are brought into said abutting position.

10. The clock of claim 6 wherein the magnetically-responsive coupling element is a magnet having a north poll and a south pole and sized to move freely within said generally enclosed space so that either of said poles can generally abut the interior surface wall of either body portion.

11. The clock of claim 10 wherein the respective dimensions of the generally cylindrical, inwardly-extending walls are such that one fits within the other to form the generally enclosed space within the time-indicating element when the two mating body portions are brought into said abutting position.

12. The clock of claim 1 wherein the magnetically responsive element is affixed to the interior of the time-indicating element.

13. The clock of claim 1 further including a rib positioned between the guide element and dial for interfacing therebetween as the guide element moves as a function of time so as to support the guide means for sliding movement with reduced friction.

14. The clock of claim 1 including an arm having proximal and distal ends located on opposite sides of the middle region, and mounted at its middle region for rotational movement of its two ends by the moving means about a non-vertical axis, the guide means being carried at the proximal end of the arm.

15. The clock of claim 13 wherein the arm is counterweighted at its distal ends to substantially offset the tendency of the guide element to pivot its end towards the dial to reduce the amount of friction acting against movement of the guide element.

16. The clock of claim 1 where in the arm includes a spindle-accommodating aperture in its middle region, and the clock further includes a motor for rotating said spindle about an axis generally perpendicular to said dial.

17. The clock of claim 1 wherein the time-indicating element comprises two mating body portions of magnetically non-responsive material having respective interior and exterior wall surfaces and a respective mating face extending therebetween, said faces mating with each other along at least one seam to form a generally hollow shell defined by said interior and exterior wall surfaces, each of the two mating body portions having an open-ended, generally cylindrical wall extending inwardly from its interior wall towards and at least substantially to the plane of its mating face, the respective sizes and positions of the generally cylindrical wall being such that the inwardly-extending cylindrical wall of one of the body portions forms a generally enclosed space within the time-indicating element in cooperation with the inwardly-extending generally cylindrical wall of the other body portion when the two body portions are mated to form the time-indicating element.

18. The clock of claim 17 wherein the magnetically-responsive coupling element is a magnet having a north pole and a south pole and sized to move freely within said generally enclosed space so that either of said poles can generally abut the interior wall of either body portion.

19. A clock with a seemingly gravity-defying time-indicating element comprising:

a dial;

a guide element formed at least in part from magnetically responsive material and positioned behind the dial for movement around the dial as a function of time;

means for moving the guide element around the dial as a function of time;

a time-indicating element positioned for viewer visibility in front of the dial, the time-indicating element being less dense than the density of magnetically-responsive metal;

a magnetically-responsive coupling element mechanically coupled to the time-indicating element for movement therewith and magnetically coupled to the guide element through the dial for time-responsive movement of the time-indicating element, at least one of the guide element and coupling element being a magnet, and a rib positioned between the guide element and dial for interfacing therebetween as the guide element moves as a function of time so as to support the guide means for sliding movement with reduced friction.

20. A clock with a seemingly gravity-defying time-indicating element comprising:

a dial;

a magnetically-responsive guide element positioned behind the dial for movement around the dial as a function of time;

means for supporting the guide element for movement around the dial as a function of time; said supporting means including an open-ended pocket oriented with its open end adjacent the dial;

a time-indicating element positioned for viewer visibility in front of the dial, the time-indicating element being less dense than the density of magnetically-responsive metal; and a magnetically-responsive coupling element mechanically coupled to the time-indicating element for movement therewith and magnetically coupled to the guide element through the dial for time-responsive movement of the time-indicating element, at least one of the guide element and coupling element being a magnet, the pocket being sized to loosely capture the magnetically-responsive guide element sufficiently to enable the guide element to move towards the dial without exerting a force on the supporting means.

21. A clock with a seemingly gravity-defying time-indicating element comprising:

a dial;

a guide element formed at least in part from magnetically responsive material and positioned behind the dial for movement around the dial as a function of time;

means for moving the guide element around the dial as a function of time;

a generally hollow time-indicating element defined by interior and exterior walls and positioned for viewer visibility in front of the dial, the time-indicating element being less dense than the density of magnetically-responsive metal and consisting of a pair of mating body parts that sealingly abut along respective faces to form the generally hollow time-indicating element, each of the mating body parts having an open-ended, generally cylindrical wall extending inwardly from the inside wall of the body part towards and beyond the plane of the face, the respective dimensions of the walls being such that the inwardly extending wall of one of the body parts forms a generally enclosed space within the time-indicating element in cooperation with the wall of the other body part when the two body parts are brought into said abutting position; and a magnetically-responsive coupling element within the generally enclosed space and magnetically coupled to the guide element through the dial for time-responsive movement of the time-indicating element, at least one of the guide element and coupling element being a magnet.

22. The clock of claim 21 wherein the magnetically responsive element is captured within the generally enclosed space.

23. The clock of claim 22 wherein the captured magnetically responsive element is freely movable in one dimension.

24. The clock of claim 21 wherein the respective dimensions of the generally cylindrical, inwardly-extending walls are such that at least a portion of one fits within at least a portion of the other to form the generally enclosed space within the time-indicating element when the two mating body portions are brought into said abutting position.

25. The clock of claim 21 wherein the magnetically-responsive coupling element is a magnet having a north poll and a south pole and sized to move freely within said generally enclosed space so that either of said poles can generally abut the interior surface wall of either body portion.

26. The clock of claim 25 wherein the respective dimensions of the generally cylindrical, inwardly-extending walls are such that one fits within the other to form the generally enclosed space within the time-indicating element when the two mating body portions are brought into said abutting position.

27. A clock with a seemingly gravity-defying time-indicating element comprising:

a dial;

a guide element formed at least in part from magnetically responsive material and positioned behind the dial for movement around the dial as a function of time;

means for moving the guide element around the dial as a function of time;

a generally hollow time-indicating element defined by interior and exterior walls and positioned for viewer visibility in front of the dial, the time-indicating element being less dense than the density of magnetically-resposive metal and comprising two mating body portions of magnetically non-responsive material having respective interior and exterior wall surfaces and a respective mating face extending therebetween, said faces mating with each other along at least one seam to form a generally hollow shell defined by said interior and exterior wall surfaces, each of the two mating body portions having an open-ended, generally cylindrical wall extending inwardly from its interior wall towards and at least substantially to the plane of its mating face, the respective sizes and positions of the generally cylindrical wall being such that the inwardly-extending cylindrical wall of one of the body portions forms a generally enclosed space within the time-indicating element in cooperation with the inwardly-extending generally cylindrical wall of the other body portion when the two body portions are mated to form the time-indicating element; and a magnetically-responsive coupling element within the generally enclosed space and magnetically coupled to the guide element through the dial for time-responsive movement of the time-indicating element, at least one of the guide element and coupling element being a magnet.

28. The clock of claim 27 wherein the magnetically-responsive coupling element is a magnet having a north pole and a south pole and sized to move freely within said generally enclosed space so that either of said poles can generally abut the interior wall of either body portion.

* * * * *